US008505524B2

(12) United States Patent
Lyon

(10) Patent No.: US 8,505,524 B2
(45) Date of Patent: Aug. 13, 2013

(54) BOW APPARATUS AND METHOD FOR PLAYING ARCHERY GOLF

(76) Inventor: Robert Arthur Lyon, Brownington, VT (US)

( * ) Notice: Subject to any disclaimer, the term of this patent is extended or adjusted under 35 U.S.C. 154(b) by 342 days.

(21) Appl. No.: 12/924,646

(22) Filed: Oct. 1, 2010

(65) Prior Publication Data

US 2011/0214653 A1 Sep. 8, 2011

Related U.S. Application Data

(60) Provisional application No. 61/339,292, filed on Mar. 2, 2010.

(51) Int. Cl.

| | |
|---|---|
| ***F41B 5/14*** | (2006.01) |
| ***F41B 5/22*** | (2006.01) |
| ***A63B 67/02*** | (2006.01) |
| *A63B 69/36* | (2006.01) |

(52) U.S. Cl.

CPC ..... *F41B 5/1484* (2013.01); *F41B 5/143* (2013.01); *A63B 69/36* (2013.01)

USPC ..... 124/24.1; 124/23.1; 124/44.5; 124/86; 473/409

(58) Field of Classification Search

CPC ..... F41B 5/1484; F41B 5/143; A63B 69/36

USPC ..... 124/23.1, 24.1, 44.5; 473/409

See application file for complete search history.

(56) References Cited

U.S. PATENT DOCUMENTS

| | | | | | |
|---|---|---|---|---|---|
| 224,254 | A | * | 2/1880 | Warne | 273/364 |
| 2,069,821 | A | * | 2/1937 | Douglas | 124/67 |
| 2,214,224 | A | * | 9/1940 | Douglas | 124/67 |
| 3,630,186 | A | * | 12/1971 | Babyn | 124/23.1 |
| 4,027,645 | A | * | 6/1977 | Damron | 124/24.1 |
| 4,086,901 | A | * | 5/1978 | Clement | 124/21 |
| 4,261,321 | A | * | 4/1981 | Nishioka | 124/67 |
| 4,386,598 | A | * | 6/1983 | Blaser | 124/21 |
| 4,471,962 | A | * | 9/1984 | Godfrey | 473/582 |
| 4,623,145 | A | * | 11/1986 | Paraskevakos | 482/112 |
| 4,708,341 | A | * | 11/1987 | Paraskevakos | 482/120 |
| 5,224,464 | A | * | 7/1993 | Burnham et al. | 124/67 |
| 5,242,323 | A | * | 9/1993 | Rappaport | 446/180 |
| 5,649,519 | A | * | 7/1997 | Linderman | 124/23.1 |
| 5,678,528 | A | * | 10/1997 | Hadley | 124/25 |
| 5,711,284 | A | * | 1/1998 | Keenan, Jr. | 124/49 |
| 6,076,513 | A | * | 6/2000 | Doherty et al. | 124/66 |
| 6,142,895 | A | * | 11/2000 | Jason | 473/577 |
| 6,499,478 | B1 | * | 12/2002 | Perez | 124/86 |

(Continued)

*Primary Examiner* — Gene Kim
*Assistant Examiner* — Alexander Niconovich
(74) *Attorney, Agent, or Firm* — Thomas G. Ference

(57) ABSTRACT

A bow apparatus comprising a bow having first and second tips, a string which is attached between the first and second tips, and a shaft having a first shaft end and a second shaft end. The first shaft end is secured proximate the midpoint of the string. The shaft passes through a shaft stabilizer. The second shaft end has a golf ball holder. The bow apparatus is used to play a new modified version of archery golf by holding a golf ball with the golf ball holder. The user pulls the shaft to tension the string, aims the shaft towards the cup target, and then releases the shaft to project the golf ball towards the cup target. The bow apparatus further comprises a putter block for hitting the golf ball into the cup target once the golf ball is close to the cup target and on the green.

20 Claims, 12 Drawing Sheets

(56) References Cited

U.S. PATENT DOCUMENTS

| | | | | |
|---|---|---|---|---|
| 6,749,528 | B2 * | 6/2004 | Wengert | 473/409 |
| 7,063,623 | B2 * | 6/2006 | Wengert | 473/131 |
| 7,216,643 | B2 * | 5/2007 | Pellerite | 124/86 |
| 7,448,371 | B2 * | 11/2008 | Sapir | 124/16 |
| 7,665,453 | B1 * | 2/2010 | D'Agostino | 124/5 |
| 8,087,405 | B2 * | 1/2012 | Mitchell | 124/67 |
| 2004/0224793 | A1 * | 11/2004 | Wengert | 473/409 |
| 2008/0096702 | A1 * | 4/2008 | Martin | 473/581 |

* cited by examiner

BOW APPARATUS AND METHOD FOR PLAYING ARCHERY GOLF

RELATED APPLICATIONS

This application claims the benefit of priority of U.S. Provisional Patent Application No. 61/339,292, filed Mar. 2, 2010 entitled "Bow Apparatus and Method for Playing Archery Golf", which is incorporated herein by reference.

FIELD

This patent application generally relates to a bow apparatus for projecting objects. More specifically it relates to a bow apparatus for projecting golf balls used to play a modified version of archery golf and other games.

BACKGROUND

Golf is one of the most played sports in the world with over 50 million players. Archery is also a popular sport with millions of players. The current combination version of these two sports is archery golf, a sport where the players play golf with bows and arrows instead of clubs and balls. In archery golf, the arrows are used to knock a ball off of a stand instead of hitting a ball into a cup. The current patent application provides for a new version of archery golf that uses a bow apparatus that can project balls into cups.

SUMMARY

One aspect of the present patent application is directed to a bow apparatus comprising a bow having first and second tips, a string which is attached to the bow between the first and second tips and a shaft having a first shaft end and a second shaft end. The first shaft end is secured proximate the midpoint of the string. The shaft passes through a shaft stabilizer. The shaft stabilizer is mounted proximate the midpoint of the bow. The second shaft end has a golf ball holder.

Another aspect of the present patent application is directed to method of projecting a golf ball comprising providing a bow having first and second tips, a string which is attached to the bow between the first and second tips, and a shaft having a first shaft end and a second shaft end. The first shaft end is secured proximate the midpoint of the string. The shaft passes through a shaft stabilizer. The shaft stabilizer is mounted proximate the midpoint of the bow. The second shaft end has a golf ball holder. The user then holds a golf ball with the golf ball holder, pulls the shaft to tension the string, aims the shaft towards a target, and then releases the shaft to project the golf ball towards the target.

Still another aspect of the present patent application is directed to a method of projecting a golf ball comprising providing a bow having first and second tips, a string which is attached to the bow between the first and second tips, and a shaft having a first shaft end and a second shaft end. The first shaft end is secured proximate the midpoint of the string. The shaft passes through a shaft stabilizer. The shaft stabilizer is mounted proximate the midpoint of the bow. The second shaft end has a putter block. The user pulls the shaft to tension the string, aims the shaft towards a golf ball, and then releases the shaft to hit the golf ball with the putter block so as to project the golf ball towards a target.

Still yet another aspect of the present patent application is directed to a kit for converting a bow apparatus for shooting arrows into a bow apparatus for launching golf balls, the bow having a string attached between tips of the bow, the kit comprising a shaft having a first shaft end and a second shaft end. A string securing element is mounted to the first shaft end to secure the shaft to the string. A golf ball holder is mounted to the second shaft end. A shaft stabilizer having a stabilizer opening through which to move said shaft, the shaft stabilizer reduces the angular deflection of the shaft as the shaft passes through the stabilizer opening. The shaft stabilizer has a shaft stabilizer fastener for attachment proximate the midpoint of the bow.

BRIEF DESCRIPTION OF DRAWINGS

The foregoing and other aspects and advantages of the invention will be apparent from the following detailed description of the invention, as illustrated in the accompanying drawings, in which.

DETAILED DESCRIPTION

Figure 1:
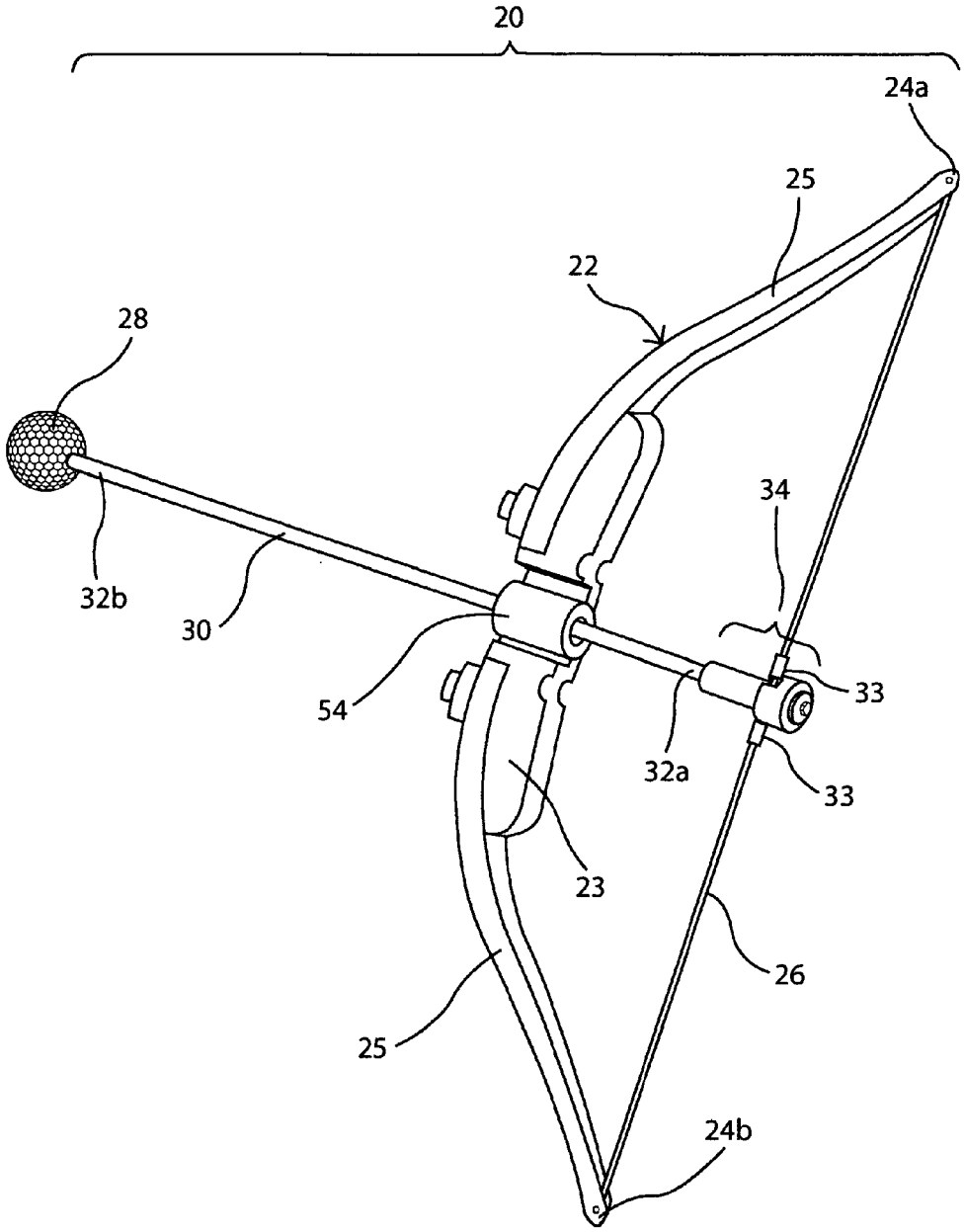
FIG. 1 is a perspective view of the bow apparatus.
Figure 2A:
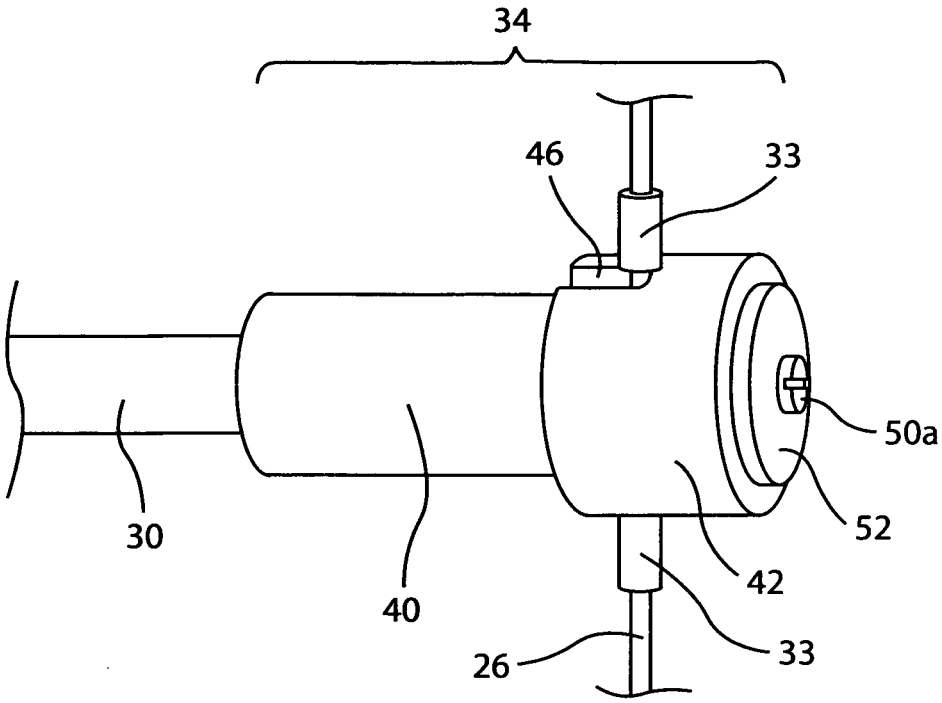
FIG. 2*a* is a perspective view of the first shaft end, string securing element, and string of FIG. 1.
Figure 2B:
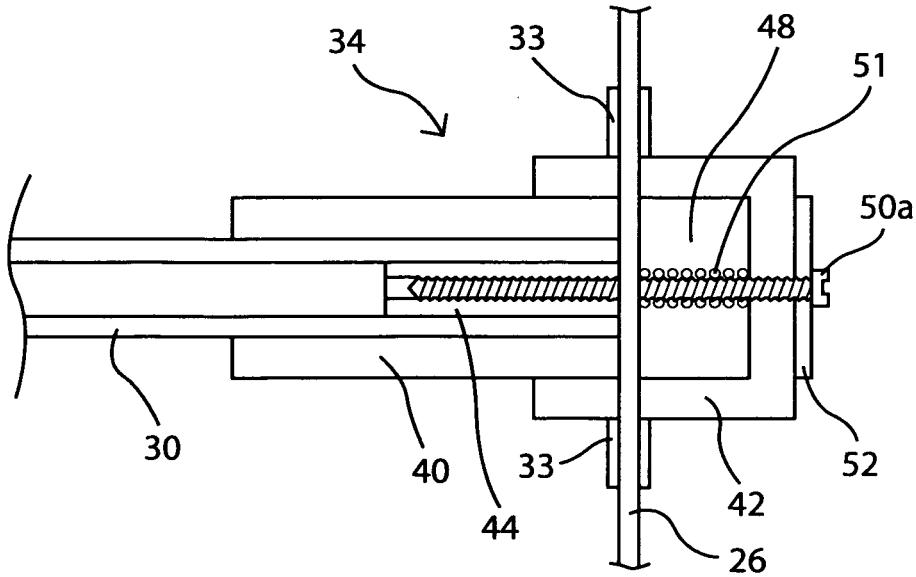
FIG. 2*b* is a sectional view of the first shaft end, string securing element, and string of FIG. 2*a* with the string secured to the shaft.
Figure 2C:
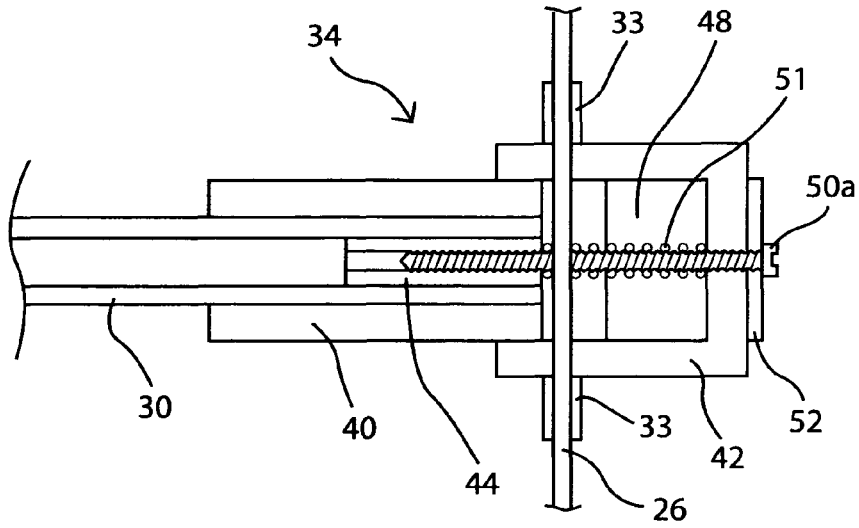
FIG. 2*c* is a sectional view of the first shaft end, string securing element, and string of FIG. 2*a* with the string securing element in a loosened state.
Figure 2D:
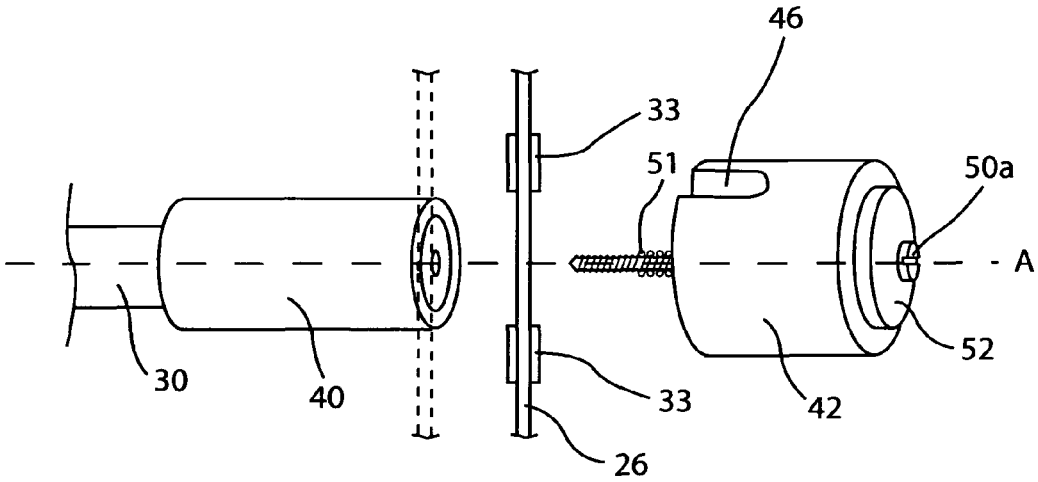
FIG. 2*d* is an exploded view of the first shaft end, string securing element, and string of FIG. 2*a;*

FIGS. 1-11*b* illustrate the elements of bow apparatus 20 and how they work together to play a modified version of archery golf and other games. Bow apparatus 20, FIG. 1, comprises bow 22 having a first tip 24*a* and a second tip 24*b*. Bow 22 may be a recurve bow, a compound bow or any other suitable archer's bow. Bow 22 may be of unitary structure or the bow may be fabricated form several pieces such as a riser 23 (a.k.a. handle) and two limbs 25 that are secured together. The shape and material of riser 23 and limbs 25 may vary depending on the performance requirements of bow apparatus 20. String 26 spans between first tip 24*a* and second tip 24*b*. String 26 is secured to bow 22 at first tip 24*a* and second tip 24*b*. String 26 may be a string, a strap or other long thin strip of flexible material. String 26 and bow 22 combine to provide a mechanism for building up stored energy that can be imparted to an object or projectile 28, such as a golf ball, that is to be propelled through the air. Bow apparatus 20 further comprises a shaft 30 having a first shaft end 32*a* and a second shaft end 32*b*. Shaft 30 is similar in construction to the shaft of a conventional arrow in length, diameter and material. Although preferably circular in cross-section, shaft 30 may take on any cross-sectional shape. Shaft 30 is preferably made of a light and rigid material such as wood, an aluminum tube, a plastic rod or tube, etc. First shaft end 32*a* is secured to string 26 by a string securing element 34 mounted to the first shaft end. First shaft end 32*a* is secured proximate the midpoint of string 26. String positioning elements 33, such as rubber sleeves or brass knots, maybe provided to help stabilize the location of string securing element 34 and keep the string securing element from sliding along the length of string 26. Shaft 30 passes through shaft stabilizer 54. Shaft stabilizer 54 is mounted proximate the midpoint of bow 20. Second shaft end 32*b* has a projectile holder 38. Shaft 30 is unrestricted from string securing element 34 to shaft stabilizer 54.

Details of string securing element 34 are shown in FIGS. 2*a-d*. String securing element 34 may surround string 26 or the string securing element may press on the string from opposite sides. String 26 may be secured at a location off axis (shown as dashed lines) from the central axis A of shaft 30, seen in FIG. 2*d*. Alternatively string securing element 34 may be configured to secure string 26 on the central axis A of shaft 30. In one embodiment, string securing element 34 includes a first securing element 40 and a second securing element 42 that together engage opposite sides of string 26 to secure first shaft end 32*a* to the string. First string securing element 40 is mounted to shaft 30 at the first shaft end 32*a*. A plug 44 is mounted within the first shaft end 32*a* if shaft 30 is tubular. Second securing element 42 is dimensioned to integrate with first securing element 40. A string groove 46 is provided in string securing element 34 so that string 26 can be easily located to pass through the string securing element. A resilient material 48 and biasing element 51 may be provided within second securing element 42 to aid in securing and releasing the second securing element from string 26. Biasing element 51, such as a spring may be included to help separate first securing element 40 from second securing element 42 when attaching string securing element 34 to string 26. A string fastener 50*a*, with optional washer 52, is used to tighten and loosen second securing element 42 from first securing element 40. Other embodiments for string securing element 34 may include a single string securing element that is bonded to string 26, a single string securing element that surrounds and moves along the string or a string securing element that clamps onto the string.

Figure 3A:
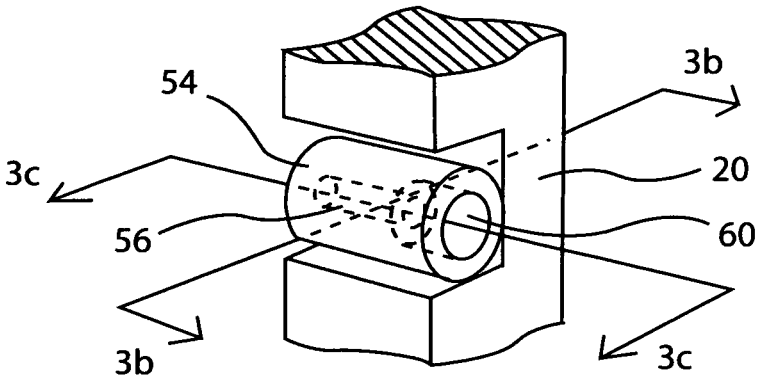
FIG. 3*a* is a perspective view of the shaft stabilizer of FIG. 1 attached to the bow.
Figure 3B:
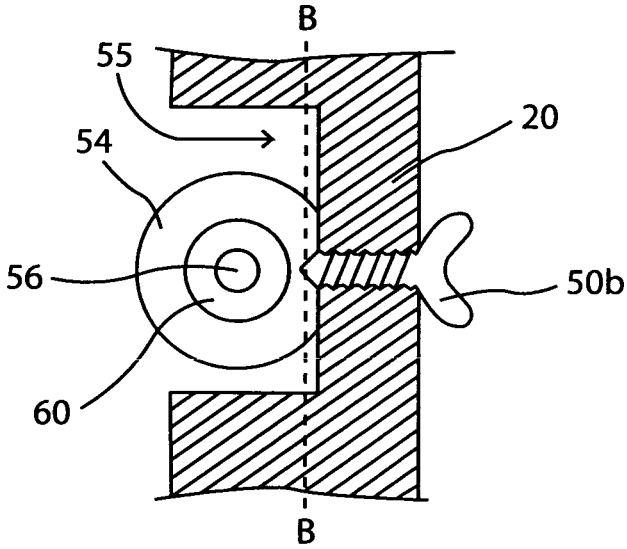
FIG. 3*b* is a sectional view along line 3*b*-3*b* of FIG. 3*a;*
Figure 3C:
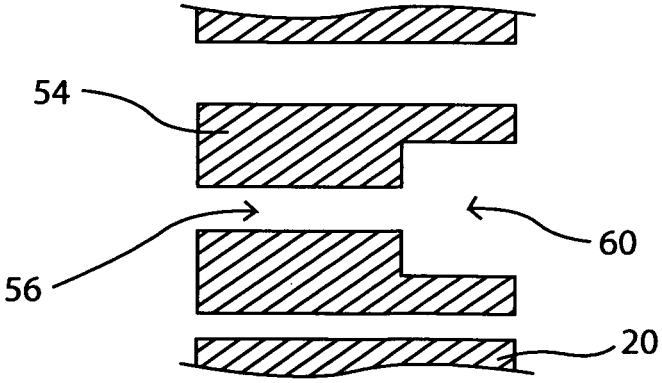
FIG. 3*c* is a sectional view alone line 3*c*-3*c* of FIG. 3*a;*

Details of shaft stabilizer 54 are shown in FIGS. 3*a-c*. Shaft stabilizer 54 is located proximate the midpoint of bow 20 and may be an integral part of the bow or attached by a shaft stabilizer fastener 50*b*. Shaft stabilizer 54 is preferably off-centered laterally from the mid-plane B of bow 22 and located within recess 55 of riser 23. Having shaft stabilizer 54, shaft 30 and string groove 46 off-center from the mid-plane of the bow allows the user to aim the shaft and projectile 28 without bow 22 obstructing their view. Providing a larger recess 55 along riser 23 may also aid the user in viewing the aim of the projectile. The riser may also include a site or aim location element. Shaft stabilizer 54 includes a stabilizer opening 56 shaped to match that of the outer cross-sectional dimensions of shaft 30, but with the diameter of the stabilizer opening slightly larger than the diameter of the shaft. Stabilizer opening 56 reduces angular deflection of shaft 30 as the shaft passes through shaft stabilizer 54, i.e. when launching a projectile. Stabilizer opening 56 is preferably an elongated stabilizer opening formed in an elongated shaft stabilizer 54 where more length provides more stability. Shaft stabilizer 54 is critical for providing accurate aim of shaft 30, especially when a projectile such as a golf ball is held at the second shaft end 32*b*. Shaft stabilizer fastener 50*b* can be used to adjust the positioning and angular orientation of the shaft stabilizer 54 relative to bow 22 so as to adjust for height range and windage.

Figure 4A:
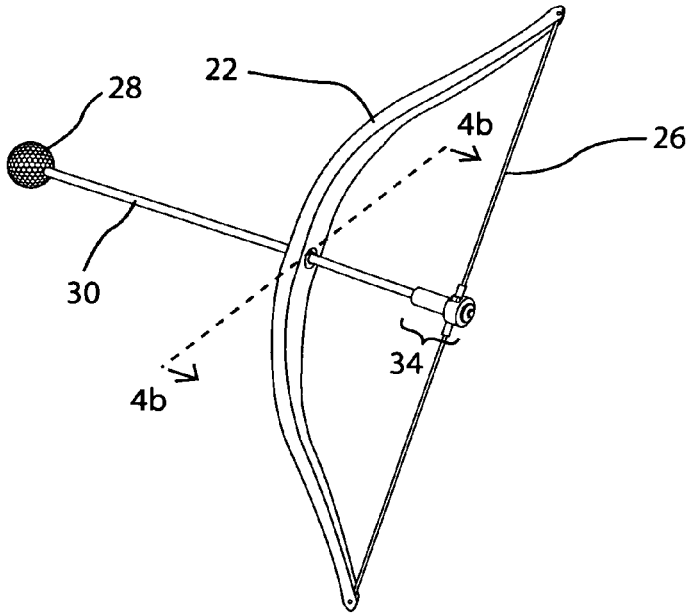
FIG. 4*a* is a perspective view of one embodiment of the bow apparatus in FIG. 1, where the shaft stabilizer is built into the bow.
Figure 4B:
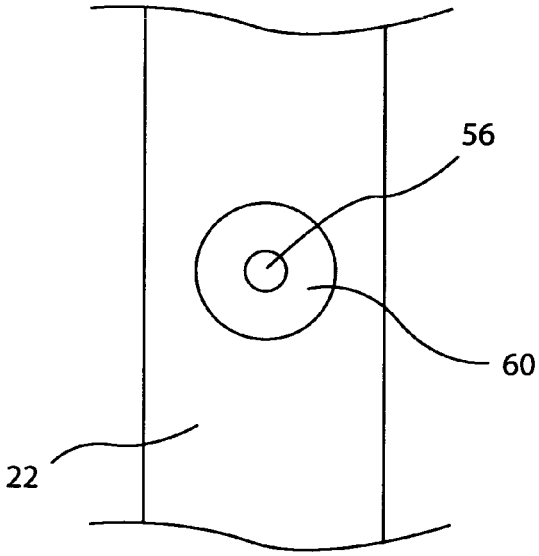
FIG. 4*b* is a sectional view along line 4*b*-4*b* of FIG. 4*a.*
Figure 4C:
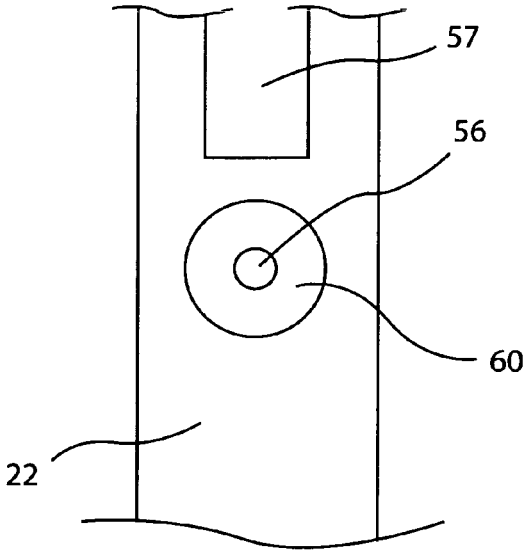
FIG. 4*c* is a sectional view of the shaft stabilizer and bow in FIGS. 4*a* and 4*b* with an added site opening within the bow.
Figure 5:
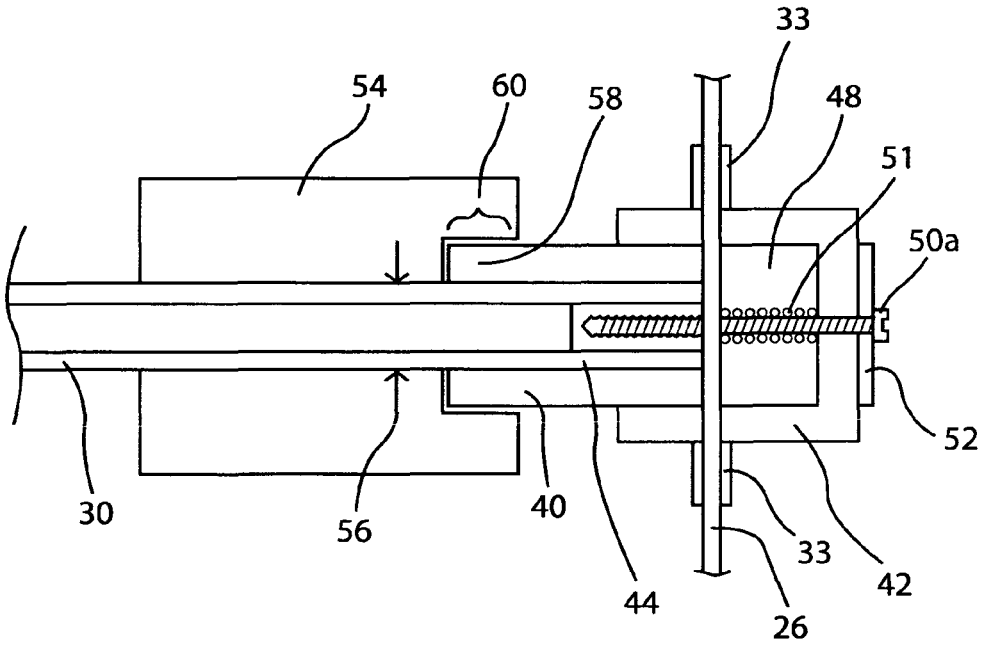
FIG. 5 is a sectional view of the shaft stabilizer and safety element of FIG. 1 shown in an engaged state.

In one embodiment, FIGS. 4*a-c*, stabilizer opening 56 and shaft stabilizer 54 may be fabricated to reside within the bow 22 itself and not be a separate element. A sight opening 57 may also be provided to aid the user in aiming projectile 28.

During use of bow apparatus 20, if for some reason string securing element 34 or string 26 was to fail, the user would not want shaft 30 to release and jab into someone or something. For this reason, bow apparatus 20 is may be fitted with a shaft safety element 58. In one embodiment, FIG. 5, shaft safety element 58 is an area of enlarge diameter around shaft 30 near first shaft end 32*a* that is larger than the diameter of stabilizer opening 56. This shaft safety element 58 may be an integral part of first string securing element 42 or shaft 30, or a separate element. A shaft safety element channel 60 may be provided within shaft stabilizer 54 for accepting the shaft safety element 58. Providing a taper on both shaft safety element 58 and shaft safety element channel 60 can help with engaging these two elements. In an alternative embodiment of bow apparatus 20, shaft safety element may be a safety strap running from shaft 30 to string 26.

Bow apparatus 20 has a projectile holder 38, such as those shown in FIG. 6*a-c* and 7*a-c*, secured to second shaft end 32*b* of shaft 30 for holding a projectile 28. Projectile 28 will be released during the act of launching the projectile. Projectile holder 38 may be secured to shaft 30 by a projectile fastener 50*c* or permanently mounted to the shaft. Projectile holder 38 preferably holds projectile 28 with an inertial release mechanism so that the projectile is released when the force of inertia of the projectile overcomes the holding force of the projectile holder during launching. The inertial release mechanism may incorporate magnetic attraction between projectile holder 38 and projectile 28 (FIG. 6*a-c* and 7*c*), frictional forces between the projectile holder and the projectile (7*a* and 7*b*), or vacuum (not shown) for the holding projectile in place while firing the projectile. Projectile holder 38 is matched in size and shape to a given projectile to be launched. Projectile holder 38 may be removeably attached to second shaft end 32*b*. One example of a removable attachment would be a thread on the end of shaft 30 that would thread into projectile holder 38. Another option is using a fastener or clip to attach projectile holder to second shaft end 32*b*. These would all provide different means for removeably securing the projectile holder. Projectile holders 38 may be interchangeable with different projectile holders put on second shaft end 32*b* to play different sports and project different projectiles 28. Projectile 28 can be one from the group including a golf ball, a paint ball, a whiffle ball, a water balloon, a bean bag or other similar objects, but not limited to these objects. For holding spherical objects such as golf balls, projectile holder 38 may be considered a golf ball holder 38*a*.

Figure 6A:
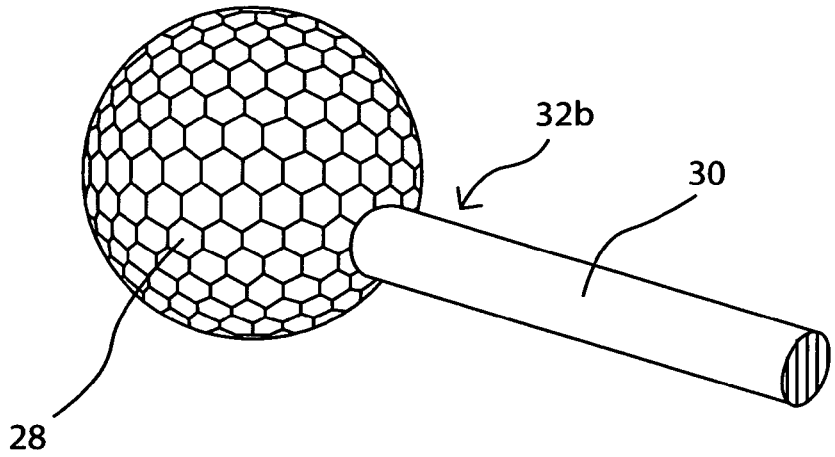
FIG. 6*a* is a perspective view of one embodiment of a projectile holder of FIG. 1 with a projectile held from within.
Figure 6B:
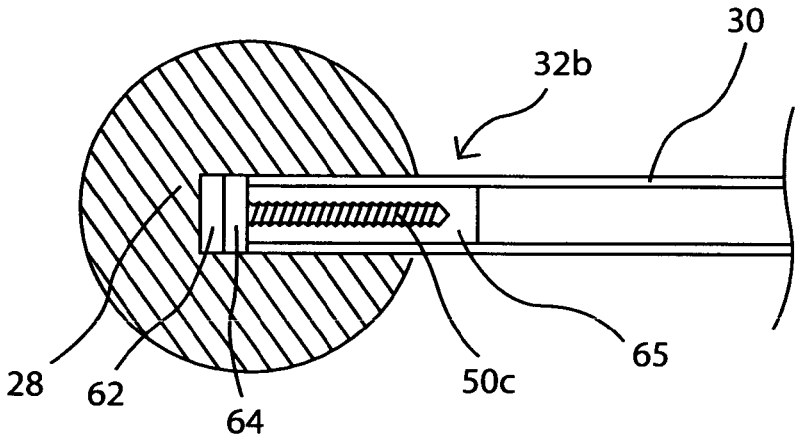
FIG. 6*b* is a sectional view of the projectile holder and projectile of FIG. 6*a;*
Figure 6C:
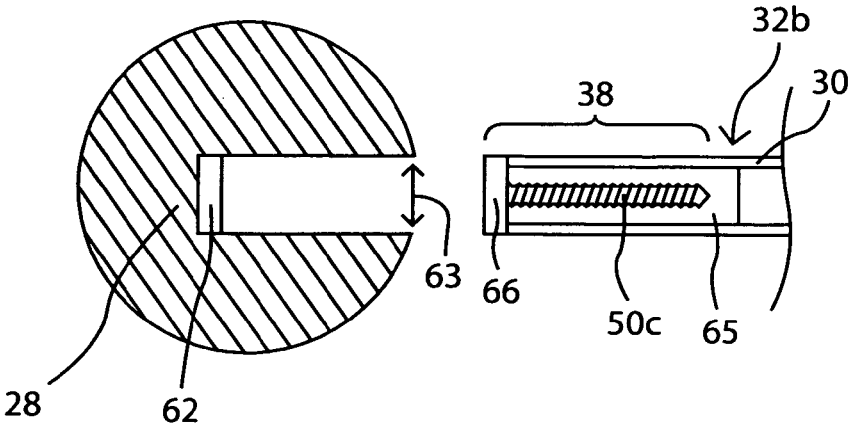
FIG. 6*c* is a sectional view of the projectile holder and projectile of FIG. 6*a* with the projectile separated from the projectile holder.

In one embodiment projectile holder 38 is structured to fit inside projectile 28, holding the projectile from an opening within the projectile, FIG. 6*a-c*. Here projectile 28 has a projectile opening 63 drilled into its center. Projectile opening 63 and golf ball holder 38*a* are such that the golf ball holder is sized to fit within the projectile opening. A first magnet 62 is provided within projectile opening 63. Second shaft end 32*b* is fitted with a plug 65 (if shaft 30 is a hollow tube) and a second magnet 64. Second magnet 64 may be secured with a magnet fastener 50*d* to second shaft end 32*b*. First magnet 62 and second magnet 64 provide enough force to hold projectile 28 on second shaft end 32*b* so that the projectile does not fall off due to gravity or minor handling of bow apparatus 20. However, the force of attraction is small compared to the inertial force that will propel projectile 28 through the air once the projectile is launched. First magnet 62 and second magnet 64 can independently be a magnet or a magnetically attracted material such as a Ferro magnet. Although a golf ball is illustrated in FIG. 6*a-c* as projectile 28, this same structure of holding the projectile could be used with other types of projectiles.

Figure 7A:
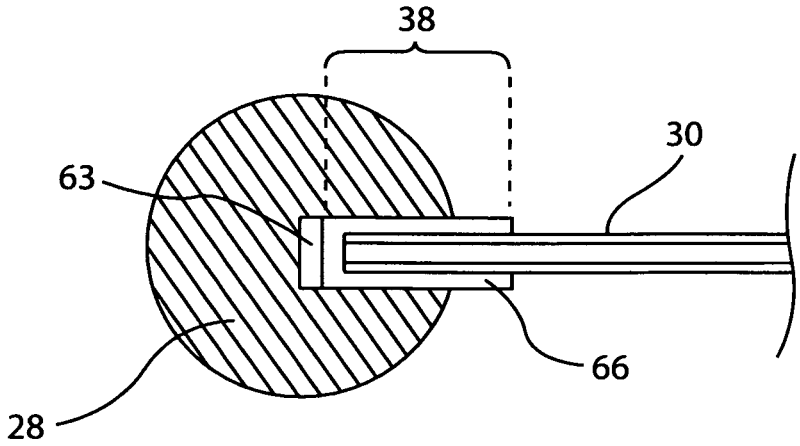
FIG. 7*a* is a sectional view of one embodiment of a projectile holder of FIG. 1 with the projectile being held by a frictional component.

In one embodiment projectile holder 38 is structured to fit inside projectile 28 holding the projectile from an opening within the projectile, FIG. 7*a*. Here projectile 28 has a projectile opening 63 drilled into its center. Projectile opening 63 and golf ball holder 38*a* are such that the golf ball holder is sized to fit within the projectile opening. A frictional material or frictional strip 66 is provided over second shaft end 32*b* to provide enough force to hold projectile 28 on second shaft end 32*b* so that the projectile does not fall off due to gravity or minor handling of bow apparatus 20. However, the force of friction is small compared to the inertial force that will propel projectile 28 through the air once the projectile is launched. Although a golf ball is illustrated in FIG. 7*a*, this same structure of holding projectile 28 could be used with other types of projectiles.

Figure 7B:
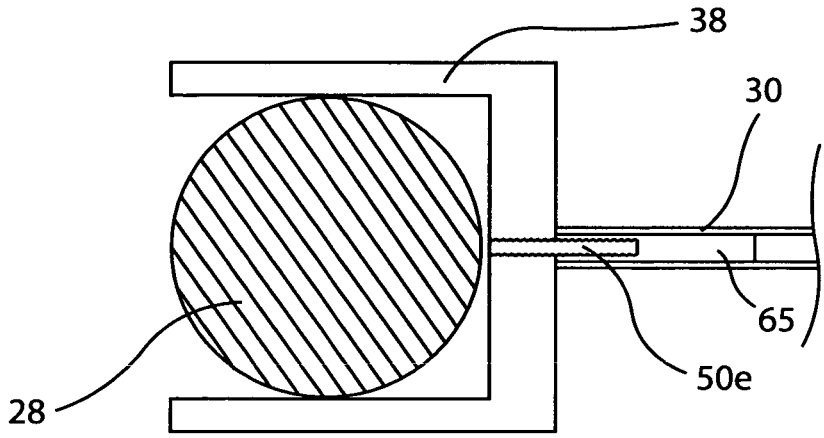
FIG. 7*b* is a sectional view of one embodiment of a projectile holder of FIG. 1 with the projectile being held by the projectile's exterior surface.

In one embodiment projectile holder 38 is structured so that projectile 28 is held by the exterior surface of the projectile, FIG. 7*b*. Here projectile holder 38 takes the form of a cup that is secured to second shaft end 32*b* by a cup fastener 50*e*. Projectile 28 is held within projectile holder 38 by frictional forces until the projectile is launched. Again, the frictional force of attraction is small compared to the inertial force that will propel projectile 28 through the air once the projectile is launched. Although a golf ball is illustrated in FIG. 7*b*, this same structure of holding projectile 28 from the exterior could be used with other types of projectiles and may be advantageous for projectiles such as water balloons or paintballs that cannot be easily held from within.

Figure 7C:
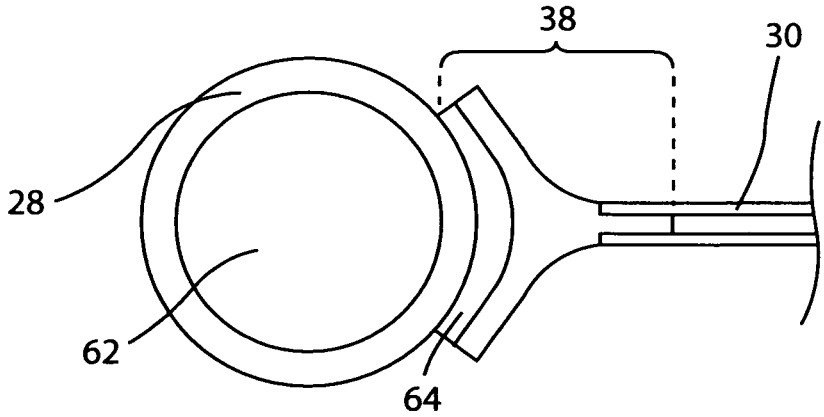
FIG. 7*c* is a sectional view of one embodiment of a projectile holder of FIG. 1 with the projectile being held by magnetic attraction between the projectile and projectile holder.

In one embodiment projectile holder 38 uses magnetic forces to hold projectile 28 by it's exterior surface, FIG. 7*c*. Projectile 28 has a first magnet 62 or magnetic material embedded within it. Projectile holder includes a second magnet 64 or magnetic material attached to second shaft end 32*b*. Projectile 28 is held to projectile holder 38 by magnetic forces until the projectile is launched. Again, the magnetic force of attraction is small compared to the inertial force that will propel projectile 28 through the air once the projectile is launched. A similar structure for projectile holder 38 could be used with a vacuum sucking on the outer surface of projectile 28, this version is not shown. Although a golf ball is illustrated in FIG. 7*c*, this same structure of holding projectile 28 could be used with other types of projectiles.

Bow apparatus 20 can be configured to project almost any type of projectile 28. However for the specific use of playing modified archery golf; bow apparatus 20 is fitted with a golf ball holder 38*a*, which may take the form of any of projectile holders 38 shown in 6*a-c* and 7*a-c*. The configuration of bow apparatus 20 for playing "ball-based" archery golf is shown in FIGS. 8*a-c*, 9*a-b* and 11*a-b*. The method of projecting golf ball 28*a* through the air is specifically shown in FIGS. 8*a-c*. User 41 first places golf ball 28*a* in or on golf ball holder 38*a*. User 41 then grasps bow apparatus 20 with one hand on bow 22 and one hand near the midpoint of string 26, FIG. 8*a*. User 41 then pulls string 26 and shaft 30 towards the user's body to tension the string, FIG. 8*b*. Once string 26 is of appropriate tension, user 41 aims shaft 30 towards the target and releases the string, FIG. 8*c*. Upon release, the built up energy from the tensioning process is transferred to shaft 30, golf ball holder 38*a* and golf ball 28*a*. Golf ball holder 38*a* and shaft 30 are only allowed to travel so far before they are stopped by their connection to string 26 via either shaft safety element 58 or string securing element 34. The momentum of golf ball 28*a* will overcome the force holding the ball by golf ball holder 28*a* and the golf ball will be released into the air. The distance golf ball 28*a* will travel is determined by the amount of potential energy created in the tensioned string 26. If user 41 pulls string 26 back further, golf ball 28*a* will be imparted more energy causing it to travel further. With a typical recurve bow, a golf ball may be launched in the range of a few feet to hundreds of feet. Forming shaft 30 and ball holder 38*a* from very light materials insures that most of the energy is transferred to golf ball 28*a* upon release.

Figure 8A:
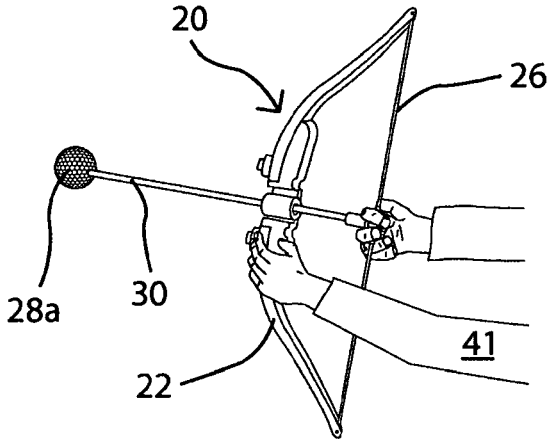
FIG. 8*a* is a perspective view of the bow apparatus of FIG. 1 (having anyone of one of the projectile holders of FIG. 6*a-b* or 7*a-c*) held by the user and loaded with a ball.
Figure 8B:
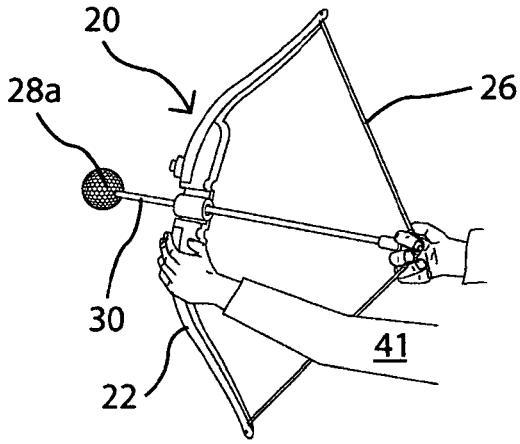
FIG. 8*b* is a perspective view of the bow apparatus of FIG. 8*a* held by the user so as to tension the string.
Figure 8C:
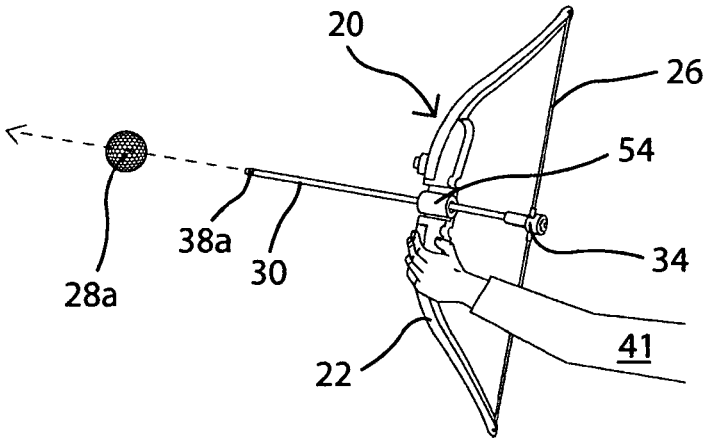
FIG. 8*c* is a perspective view of the bow apparatus of FIG. 8*b* held by the user after releasing the string and projecting the ball.
Figure 9A:
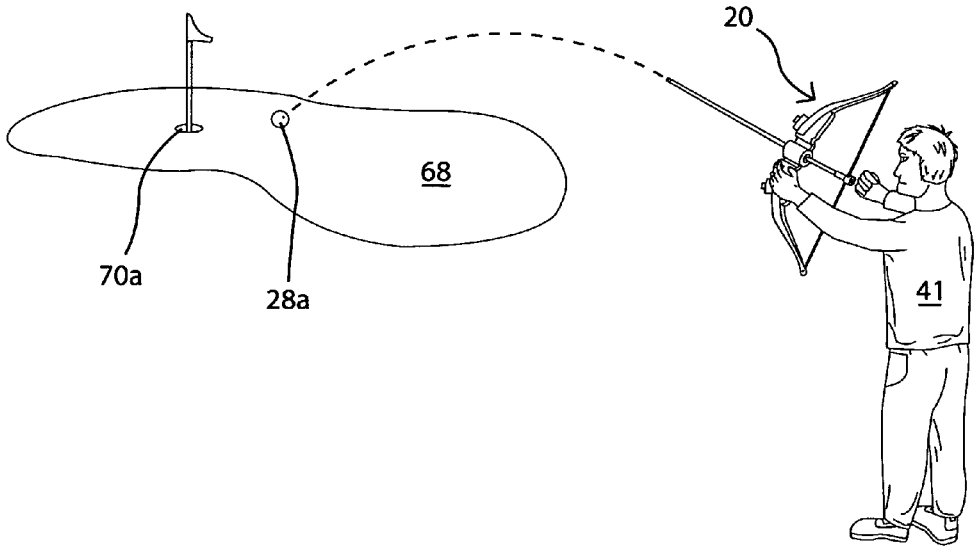
FIG. 9*a* is a diagram showing the bow apparatus of FIG. 1 being used to play a version of archery golf.
Figure 9B:
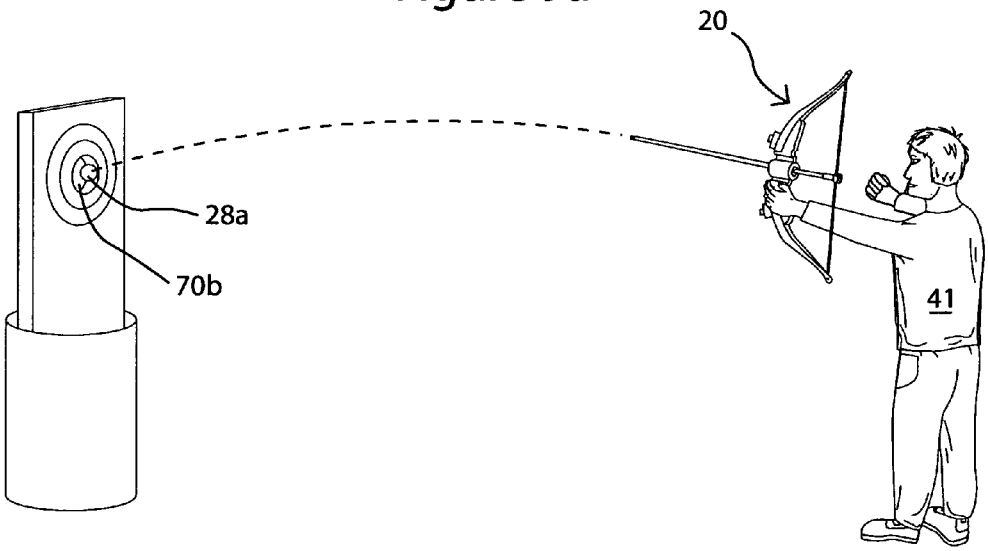
FIG. 9*b* is a diagram showing the bow apparatus of FIG. 1 being used to project balls towards a target.

FIGS. 9*a* and 9*b* illustrate two simple games that can be played with bow apparatus 20 and golf ball 28*a*. FIG. 9*a* illustrates playing "ball-based" archery golf on a standard golf course having a green 68 and cup target 70*a*. FIG. 8*b* illustrates a game of "get the ball in the standing hole target 70*b*". Because ball-based archery golf does not use arrows to hit a ball off a stand as is the case in standard archery golf, bow apparatus 20 must be modified with putter block 72 to finish the game and get golf ball 28*a* into cup target 70*a*.

Figure 10A:
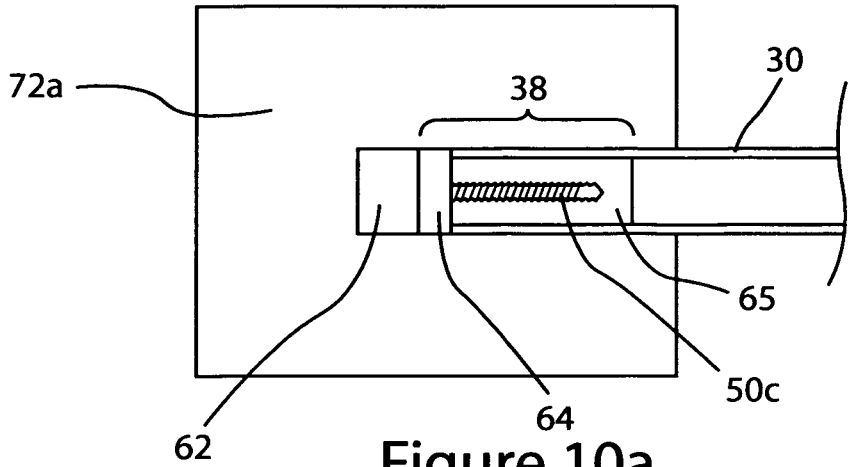
FIG. 10*a* is a sectional view of one embodiment of a projectile holder with a putter block in place as it would be integrated with the bow apparatus of FIG. 1.
Figure 10B:
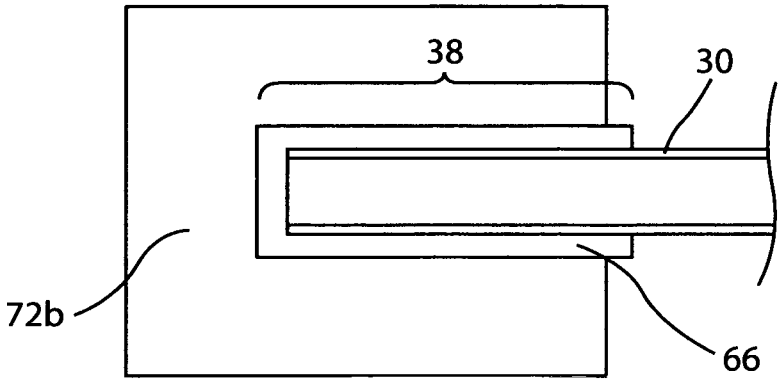
FIG. 10*b* is a sectional view of one embodiment of a projectile holder with a putter block in place as it would be integrated with the bow apparatus of FIG. 1.
Figure 10C:
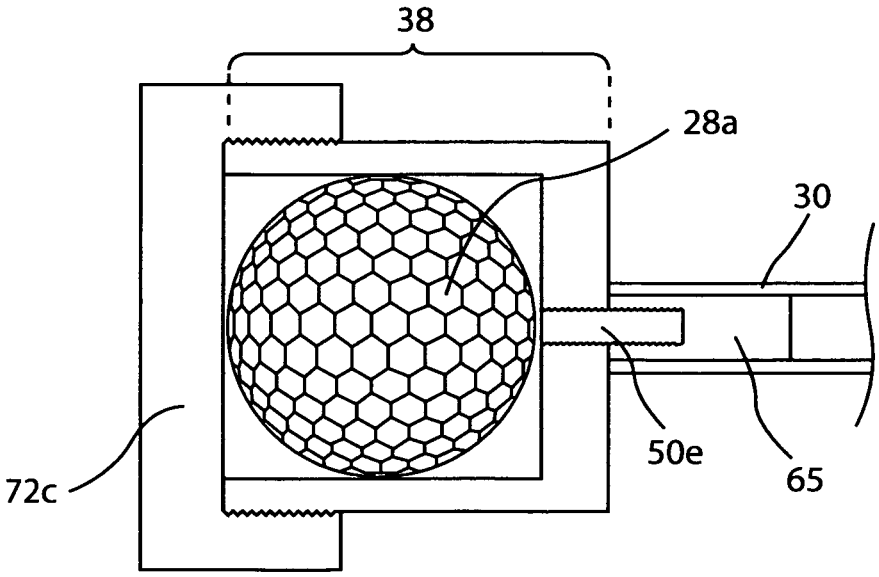
FIG. 10*c* is a sectional view of one embodiment of a projectile holder with a putter block in place as it would be integrated with the bow apparatus of FIG. 1.
Figure 11A:
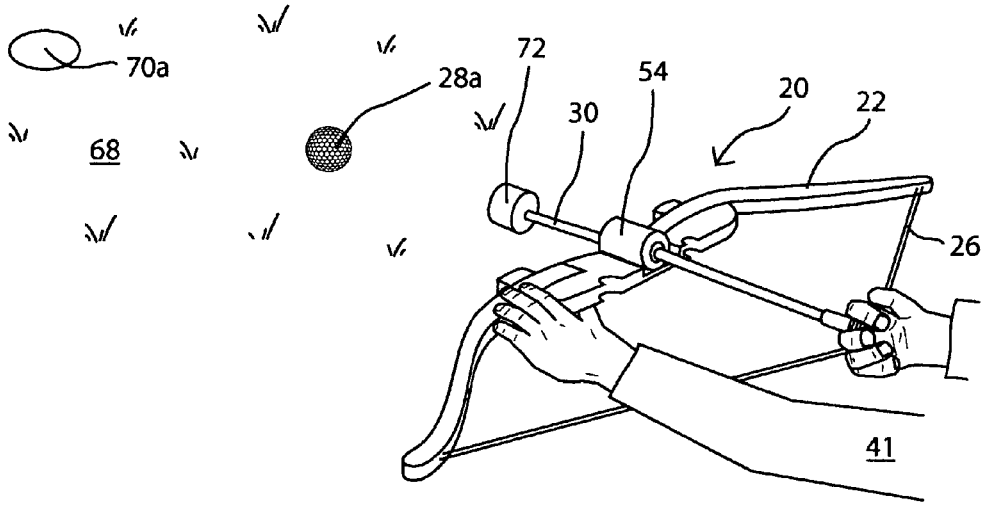
FIG. 11*a* is a perspective view of the bow apparatus of FIG. 1, now having a putter block from anyone of FIGS. 9*a-c* attached to the second shaft end and pre-tensioned to putt a ball.
Figure 11B:
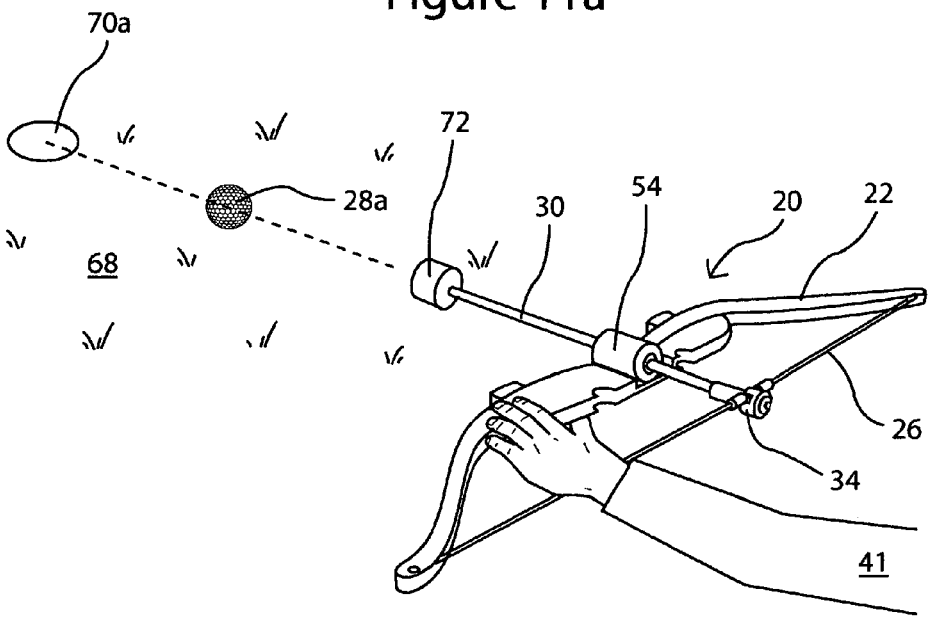
FIG. 11*b* is a perspective view of the bow apparatus of FIG. 11*a*, with the user releasing the string to hit the ball towards a cup in the ground.

FIGS. 10*a-c* show various types of putter blocks 72 (72*a-c*) that can be used depending on the type of ball holder 38 that is attached to second shaft end 32*b*. In FIG. 10*a* putter block 72*a* slides over the end of ball holder 38 and is held on by magnetic force. This would use the same ball holder 38 as shown in FIGS. 6*a-c*. The putter block can be fitted with a strong first magnet 62 to hold it from separating from ball holder 38. In FIG. 10*b* putter block 72*b* slides over the end of ball holder 38 and is held by frictional forces. This would use the same ball holder 38 as shown in FIG. 7*a*. In FIG. 10*c* putter block 72*c* may slide or be screwed onto the ball holder 38. This would use the same ball holder 38 as shown in FIG. 7*b*. The impacting end of putter block 72, the part the hits the ball, may take on any shape that can facilitate the accurate movement of ball 28*a* Putter block 72*c*, FIG. 10*c*, may also be used as a way to hold and store golf ball 28*a* in ball holder 38 when traveling between different holes on the green.

To use bow apparatus 20 with putter block 72, user 41 first places the putter block on or in ball holder 38. User 41 then grasps bow apparatus 20 with one hand on bow 22 and one hand near the midpoint of string 26. User 41 then pulls string 26 and shaft 30 towards the user's body to tension the string, FIG. 11*a*. Once string 26 is appropriately tensioned, user 41 aims shaft 30 towards golf ball 28*a* that is on the ground 74 and releases the string, FIG. 11*b*. Upon release, the built up energy from the tensioning process is transferred to shaft 30, ball holder 38 and putter block 72. When putter block 72 hits golf ball 28*a*, momentum is imparted to the golf ball and moves the golf ball towards cup target 70*a*. The distance and direction golf ball 28*a* will travel is determined by the amount of potential energy created in the tensioned string 26 and the aim of the user. In the game of ball-based archery golf, both the skill of the player and the performance of the bow apparatus play a role in the game out come.

In one embodiment bow apparatus 20 for launching projectiles 28 may be created out of a conventional bow for shooting arrows. The end result is a bow apparatus 20 as shown in FIG. 1, with the additional elements attached to the conventional bow. This is done by providing a kit that includes a shaft having a first shaft end and a second shaft end. Mounted to the first shaft end is a string securing element. Mounted to the second shaft end is a projectile holder. The shaft passes through a shaft stabilizer having an stabilizer opening that reduces the angular deflection of the shaft as it passes through the stabilizer opening. The shaft stabilizer has a shaft stabilizer fastener that is used to mount the shaft stabilizer proximate the midpoint of the conventional bow. String securing element is secured to the string of the conventional bow. This kit now attached to a conventional bow makes the bow ready for launching appropriate projectiles.

In one embodiment bow apparatus 20 may be made as a toy for kids. Bow apparatus 20 can be made to only launch projectiles short distances and with low impact force. For example bow apparatus may be structured to launch NERF®-type balls. The whole bow apparatus 20 may be fabricated inexpensively from plastic.

The invention is not limited to the embodiments represented and described above but includes all variants notably the shape and size of all components, the materials that components are manufactured from, and the type and size of objects that can be held and projected. Nothing in the above specification is intended to limit the invention more narrowly than the appended claims. The examples given are intended only to be illustrative rather than exclusive.

What is claimed is:

1. A bow apparatus for playing archery golf, comprising:

a) a golf ball;

b) a bow having first and second tips;

c) a string attached to said bow between said first and second tips;

d) a shaft having a first shaft end and a second shaft end, wherein said first shaft end is secured proximate the midpoint of said string by a string securing element, wherein said second shaft end has a golf ball holder;

e) a shaft stabilizer having an elongated stabilizer opening, wherein said shaft passes through said shaft stabilizer within said elongated stabilizer opening, wherein said shaft stabilizer is mounted proximate the midpoint of said bow; and f) wherein said shaft is unrestricted from said string securing element to said shaft stabilizer.

2. A bow apparatus as recited in claim 1, wherein said golf ball has a center and a projectile opening drilled into said center, wherein said golf ball holder is sized to fit within said projectile opening.

3. A bow apparatus as recited in claim 1, wherein said golf ball holder holds said golf ball by an exterior surface of said golf ball.

4. A bow apparatus as recited in claim 1, wherein said golf ball holder incorporates an inertial release mechanism.

5. A bow apparatus as recited in claim 4, wherein said inertial release mechanism includes magnetic attraction between said golf ball holder and said golf ball.

6. A bow apparatus as recited in claim 4, wherein said inertial release mechanism includes frictional holding between said golf ball holder and said golf ball.

7. A bow apparatus as recited in claim 1, wherein said elongated shaft stabilizer opening reduces angular deflection of said shaft when said shaft passes through said shaft stabilizer.

8. A bow apparatus as recited in claim 1, wherein said shaft stabilizer is located outside the mid plane of said bow.

9. A bow apparatus as recited in claim 1, wherein said shaft stabilizer includes a shaft stabilizer fastener to adjust the position and angular orientation of said shaft stabilizer relative to said bow so as to adjust for height range and windage of a projected golf ball.

10. A bow apparatus as recited in claim 1, wherein said string securing element surrounds said string.

11. A bow apparatus as recited in claim 1, wherein said string is secured off axis from the central axis of said shaft.

12. A bow apparatus as recited in claim 1, wherein said string securing element includes a first securing element, a second securing element and a string fastener that together engage opposite sides of said string to secure said first shaft end to said string.

13. A bow apparatus as recited in claim 12, further comprising a biasing element between said first securing element and said second securing element.

14. A bow apparatus as recited in claim 12, further comprising a resilient material between said first securing element and said second securing element.

15. A bow apparatus as recited in claim 1, further comprising a shaft safety element, wherein said shaft safety element is secured proximate said first shaft end and cannot pass through said shaft stabilizer if said string securing element or said string fails.

16. A kit for converting a bow apparatus for shooting arrows into a bow apparatus for launching golf balls, said bow apparatus including a bow having a string attached between tips of said bow, said kit comprising:

a) at least one golf ball;

b) a shaft having a first shaft end and a second shaft end;

c) a string securing element mounted to said first shaft end to secure said shaft to the string;

d) golf ball holder mounted to said second shaft end;

e) a shaft stabilizer having an elongated stabilizer opening through which to move said shaft, wherein said shaft stabilizer reduces the angular deflection of said shaft as said shaft passes through said elongated stabilizer opening, wherein said shaft stabilizer attaches proximate the midpoint of said bow; and f) whereby when said kit is attached to the bow apparatus said shaft is unrestricted from said string securing element to said shaft stabilizer.

17. A kit for converting a bow apparatus as in claim 16, further comprising a shaft safety element, wherein said shaft safety element is secured proximate said first shaft end and cannot pass through said shaft stabilizer if said string securing element or said string fails.

18. A bow apparatus for playing archery golf, comprising:

a) a putter block;

b) a bow having first and second tips;

c) a string attached to said bow between said first and second tips;

d) a shaft having a first shaft end and a second shaft end, wherein said first shaft end is secured proximate the midpoint of said string by a string securing element, wherein said second shaft end has a golf ball holder;

e) a shaft stabilizer having an elongated stabilizer opening, wherein said shaft passes through said shaft stabilizer within said elongated stabilizer opening, wherein said shaft stabilizer is mounted proximate the midpoint of said bow; and f) wherein said shaft is unrestricted from said string securing element to said shaft stabilizer.

19. A bow apparatus as recited in claim 18, wherein said putter block fits over said golf ball holder.

20. A bow apparatus as recited in claim 18, wherein said putter block has an impacting end shaped to hit a golf ball.

* * * * *